US006409301B1

(12) United States Patent
Takata et al.

(10) Patent No.: US 6,409,301 B1
(45) Date of Patent: Jun. 25, 2002

(54) INK-JET IMAGE FORMING DEVICE

(75) Inventors: Yutaka Takata; Yuichi Sugiyama; Michitaka Fukuda, all of Tokyo (JP)

(73) Assignee: Copyer Co., Ltd., Tokyo (JP)

( * ) Notice: Subject to any disclaimer, the term of this patent is extended or adjusted under 35 U.S.C. 154(b) by 0 days.

(21) Appl. No.: 09/402,141

(22) PCT Filed: Jan. 29, 1999

(86) PCT No.: PCT/JP99/00384

§ 371 (c)(1),
(2), (4) Date: Sep. 28, 1999

(87) PCT Pub. No.: WO99/38693

PCT Pub. Date: Aug. 5, 1999

(30) Foreign Application Priority Data

Jan. 30, 1998 (JP) ..... 10-034122

(51) Int. Cl.[7] ..... B41J 29/393
(52) U.S. Cl. ..... 347/19; 347/5
(58) Field of Search ..... 347/5, 14, 19

(56) References Cited

U.S. PATENT DOCUMENTS 4,827,351 A * 5/1989 Sakamoto ..... 358/447
5,321,526 A * 6/1994 Takenaka ..... 358/464

FOREIGN PATENT DOCUMENTS

EP 858897 A1 * 8/1998
JP 4-9676 2/1992
JP 7-323582 12/1995

* cited by examiner

*Primary Examiner*—John Barlow
*Assistant Examiner*—Blaise Mouttet
(74) *Attorney, Agent, or Firm*—Dellett and Walters

(57) ABSTRACT

An ink-jet image forming device such that the test pattern detecting accuracy is improved with a single photodetector. A binarizing circuit (16) which binarizes the output of a sensor for a test pattern includes a peak hold circuit (82) which follows slow change in the sensor output, a voltage dividing circuit (83) which divides the held output, and a comparator (84) which converts the sensor output into a bi-level signal by using the output of the circuit (83) as a threshold.

4 Claims, 19 Drawing Sheets

(a)

(b)
OFFSET OF
DETECTED POSITION

INK-JET IMAGE FORMING DEVICE

TECHNICAL FIELD

The present invention relates to an image forming device and particularly to such a device that includes a plurality of recording heads.

BACKGROUND ART

An ink-jet printer, a type of ink-jet image forming devices, is a device employing an ink-jet recording method which uses a head with aligned nozzles to eject ink drops therefrom to perform printing, with characteristics such as low noise, space-saving, etc. The head is fixedly mounted in position on a carriage, which is scanned across a recording paper sheet while ink drops being ejected to form an image on the paper sheet. The carriage also carries an interface circuit board necessary for driving the head.

Each nozzle is always filled with ink and provided therein with a heater element, which is heated with driving pulses to generate air bubbles in the nozzle. The bubbles are swelled to eject part of the ink within the nozzle outwardly so as to create an ink drop which will land on the paper sheet to make a printed dot.

In such an image forming device, one recording head is formed with a multitude of aligned nozzles, and hence, the nozzles in the same head are filled with the same ink from the same ink tank. To form a full-color image by an ink-jet printer, three colors, i. e., cyan, magenta and yellow, of ink are used so as to superimpose them to form an image, which realizes any color on the recording paper sheet. Therefore, a full-color ink-jet printer requires at least three heads. In practice, however, one more head of black is provided since beautiful black is not obtained with the above three colors. Thus, four heads in total, i.e., black (K), cyan (C), magenta (M) and yellow (Y), are used for printing.

The heads are located on a carriage such that the nozzles of each head are aligned in the recording paper travelling direction (sub-scanning direction). While the carriage is being scanned in the direction (main-scanning direction) perpendicular to the sub-scanning direction, ink drops are ejected onto the recording paper from the nozzles according to print data. One scanning of the carriage over a print region results in the printing of a band of image. Then, the recording paper sheet is transported in the sub-scanning direction by a predetermined amount to perform the printing of a second band, in the same manner as with the first band. By repeating such operations for third, fourth, . . . bands, an image is completed.

The four heads are removably mounted on the carriage, and hence, what determines a print position (i. e., a head position) is the carriage. In general, a positional sensor is provided in position on the carriage to detect the position of the carriage in a unit of dot in cooperation with a linear scale which is disposed along the scanning direction of the carriage. The output of the positional sensor creates the timing of the printing. In an ink-jet printer with a plurality of such heads for printing in both, back and forth, scanning directions, deviation in the position of heads mounted by a user, difference in characteristics of the heads themselves, and change in speed of the carriage produce deviation in the printing position of each head, resulting in an offset (registration offset) of the printed image for each head. For example, printed rule lines offset or vertical or horizontal stripes appear in the image, which sometimes affects significantly the image quality. The registration offset includes a sub-scanning directional offset (vertical registration offset) and a main-scanning directional offset (horizontal registration offset), for each of which another registration offset could occur between the back and forth scanning directions.

Once such registration offsets are detected, the influence of the offsets will be eliminated by correcting the printing such that with respect to the vertical registration offset, the group of nozzles to be actually used for printing is shifted in the sub-scanning direction (where the number of the nozzles of a head is set greater than that of actually used at a time), and with respect to the horizontal registration offset, the timing of ejecting ink is adjusted earlier or later.

In order to perform such correction, however, it is required for the device to accurately recognize the extent of the registration offset. The measuring of the registration offset generally falls within either of the following two methods. One is a manual registration adjustment wherein the device prints a pattern by which a user readily recognize the registration offset with the unaided eye based on the printed pattern and the user manually inputs the amount of the recognized registration offset to the device. Another is an automatic registration adjustment in which the device automatically detects the offset.

Further, the automatic registration adjustment includes a method in which the device prints a predetermined test pattern for an optical sensor to detect the pattern to determine the amount of the registration offset, and another which uses an optical ink drop detector which detects the position of an ink drop ejected from the head so that a calculation is made so as to obtain the position where the ink drop hits the medium.

Among the two automatic registration adjustment methods, the present invention employs the one that uses the test pattern to detect the amount of the registration offset. This basic technique is disclosed in Japanese patent application laid-open (KOKAI) No. 7-323582 which was filed by the applicant of this application. In this technique, a pattern-reading scan is made twice, firstly for detecting a center dot position of each of two given pattern elements, and secondly for measuring the interval of the detected two center dots. Also, an international patent publication No. WO097/14563 discloses a technique wherein two light receiving elements are employed to use the differential output thereof so as to improve the accuracy of the test pattern detection.

It is an object of the invention to provide an ink-jet image forming device capable of improving the accuracy of the test pattern detection with a single light receiving element.

It is another object of the invention to provide an ink-jet image forming device capable of reducing the time necessary for the registration adjustment by measuring the interval of the center dots of two given pattern elements in a single pattern-reading scan.

DISCLOSURE OF INVENTION

According to the present invention, there is provided an ink-jet image forming device in which a plurality of heads are scanned in a direction substantially perpendicular to a recording-medium travelling direction, the ink-jet image forming device, comprising: a test pattern printing means for printing a test pattern on a recording medium by using the plurality of heads; a light-reflection type optical sensor which is scanned across the test pattern printed on the recording medium for sequentially detecting pattern elements thereof; a binarizing circuit for binarizing an output of the light-reflection type optical sensor; a calculating circuit for obtaining a plurality of data items concerning intervals between a reference head of the plurality of heads and the other heads, according to the output of the binarizing circuit; and means for determining amounts of offsets in print position of the other heads relative to the reference head; the binarizing circuit, comprising: a peak-hold circuit for following slow change in the output of the light-reflection type optical sensor; a voltage-dividing circuit for dividing a held output of the peak-hold circuit; and a comparator for converting the output of the optical sensor into a bi-level signal by using the divided output of the voltage dividing circuit as a threshold.

With such an arrangement, the sensor output responsive to the test pattern is binarized with the threshold that dynamically changes according to the output of the peak-hold circuit which follows the slow change in the sensor output. Therefore, an adequate binarization is realized even with the deviation of the sensor output due to various factors. As a result, the offset in the inter-head printing position can accurately be detected so as to cancel the offset.

A sample-hold circuit may be used in place of the peak-hold circuit, the sample-hold circuit serving to sample and hold the output of the optical sensor during a predetermined period corresponding to the test pattern.

According to the present invention, there is provided another ink-jet image forming device in which a plurality of recording heads are scanned in a direction substantially perpendicular to a recording-medium travelling direction, the ink-jet image forming device, comprising: a test pattern printing means for printing a test pattern on a recording medium by using the plurality of heads; a light-reflection type optical sensor which is scanned across the test pattern printed on the recording medium for sequentially detecting pattern elements thereof; a binarizing circuit for binarizing an output of the light-reflection type optical sensor; a calculating circuit for obtaining a plurality of data items concerning intervals between a reference head of the plurality of heads and the other heads, according to the output of the binarizing circuit; and means for determining amounts of offsets in print position of the other heads relative to the reference head; the test pattern including a reference pattern element printed with the reference head, and a plurality of comparative pattern elements respectively printed with the plurality of heads at positions a constant designated interval away from the reference pattern element; and the calculating circuit obtaining an interval data item of one of the other heads relative to the reference head, based on the output of the optical sensor in a single scan across the test pattern.

Thus, the number of sensor scans for detecting the test pattern is reduced to one half, thereby reducing the time required for the process of correcting the offset of the head printing position.

More specifically, the calculating circuit may include a rising edge detector responsive to the output of the binarizing circuit for generating a pulse when detecting a rising edge thereof; a falling edge detector responsive to the output of the binarizing circuit for generating a pulse when detecting a falling edge thereof; a first counter for starting clock counting in response to a detected output of the rising edge detector; a register for holding a count value of the first counter in response to the pulse of the falling edge detector; a divider for halving the value held in the register; a first comparator for comparing the count value of the first counter with a predetermined set value so as to stop the counting operation of the first counter when both the values coincide with each other; a second counter for starting clock counting in response to the coincident output of the first comparator; a second comparator for comparing the count value of the second counter with the output of the divider so as to stop the counting operation of the second counter when both the values coincide; and a third counter for starting clock counting in response to the coincident output of the second comparator; the third counter stopping the clock counting in response to another coincident output of the second comparator which occurs again after staring the clock counting, the count of the third counter being used as the interval data item between the reference pattern element and the comparative pattern element.

Alternatively, the calculating circuit may include a rising edge detector responsive to the output of the binarizing circuit for generating a pulse when detecting a rising edge thereof; a falling edge detector responsive to the output of the binarizing circuit for generating a pulse when detecting a falling edge thereof; a first flip-flop for inverting an output thereof each time the pulse from the rising edge detector is received; a first counter responsive to the output of the first flip-flop for performing clock counting during a scanning period of the sensor from the leading-edge position of the reference pattern element to that of the comparative pattern element; a second flip-flop for inverting an output thereof each time an input pulse is received; a second counter responsive to the output of the second flip-flop for performing clock courting during a scanning period corresponding to a width of the reference pattern element; a third flip-flop for inverting an output thereof each time an input pulse is received; a third counter responsive to the output of the third flip-flop for performing clock counting during a scanning period corresponding to a width of the comparative pattern element; and a switching means responsive to a bi-level output of the binarizing circuit for supplying alternately to the second and third flip-flops a pair of two detected pulses of the rising and falling edge detectors; the determining means for obtaining an interval data item between the reference pattern element and the comparative pattern element on the basis of output values of the first, second and third counters, and for determining amounts of offset in print position of the other heads relative to the reference head.

In the latter calculating circuit, the test pattern may include a plurality of sets of pattern elements disposed in the sensor scanning direction, each of the sets including a reference pattern element and a plurality of comparative pattern elements; and wherein the first, second and third counters of the calculation circuit may accumulatively hold the respective count values during one scanning period of the sensor.

BEST MODE FOR CARRYING OUT THE INVENTION

Referring now to the remaining drawings, preferred embodiments of the present invention will be described. In the embodiments, an ink-jet printer is raised as an example of the ink-jet image forming device.

Figure 1:
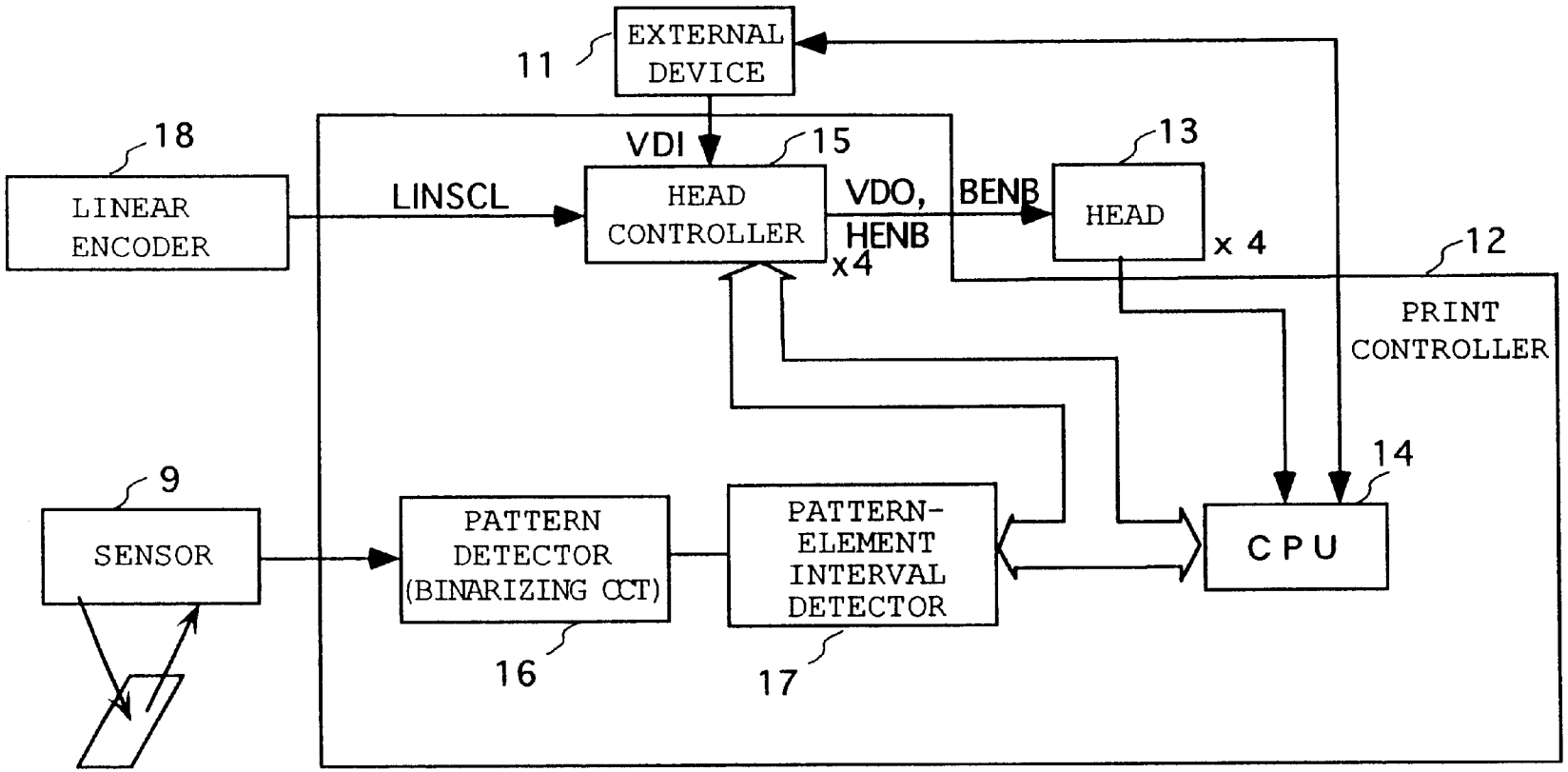
FIG. 1 is a block diagram which shows a general configuration of an ink-jet printer according to an embodiment of the present invention.
Figure 2:
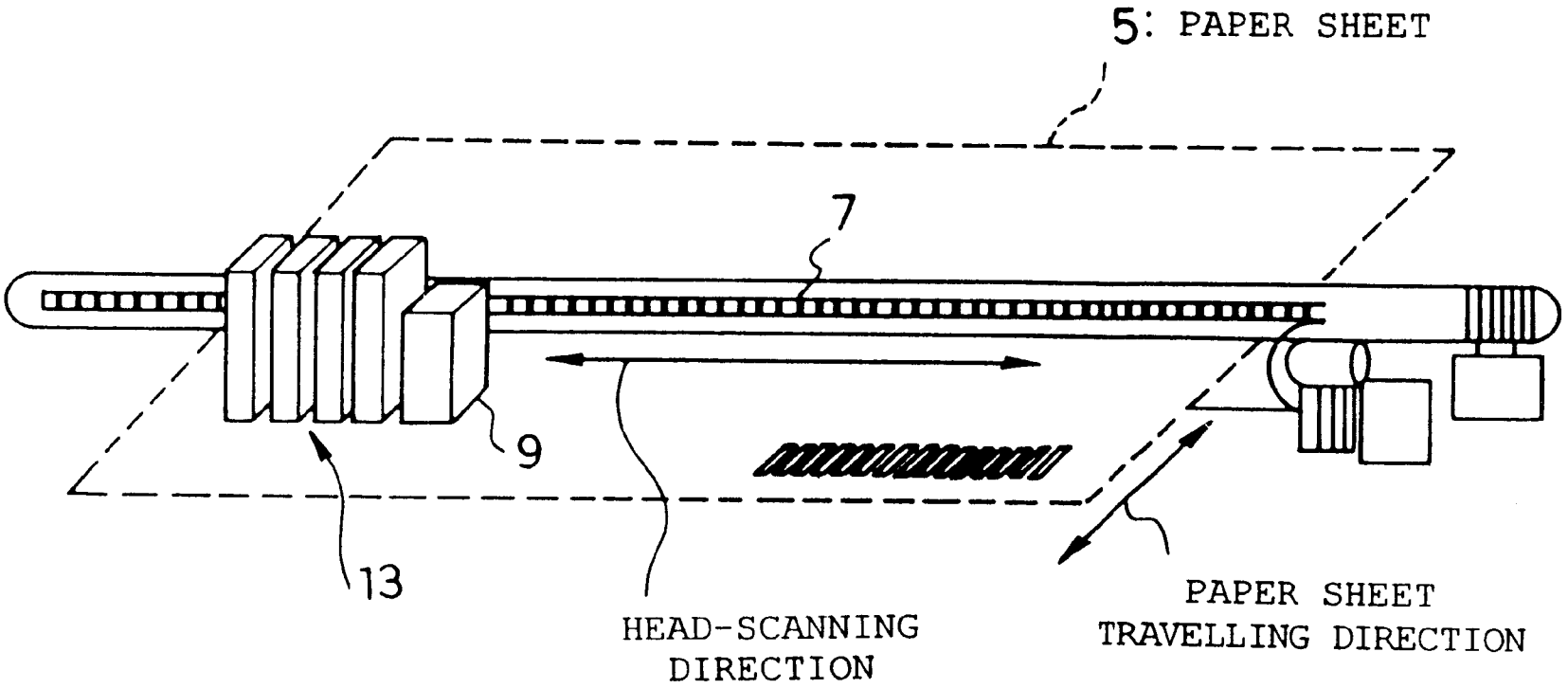
FIG. 2 shows a perspective view of the external configuration of the ink-jet printer shown in FIG. 1.

Referring first to FIG. 1, there is shown a general configuration of the ink-jet printer according to an embodiment of the invention. FIG. 2 shows a perspective view of the external configuration of the ink-jet printer.

This ink-jet printer is mainly divided into a print controller 12 and heads 13. The print controller 12 performs a predetermined process in response to incoming image data VDI and control signals from an external device such as an image scanner, personal computer and CAD device, and forms an image on a recording paper sheet (recording medium) by using the heads 13.

The print controller 12 includes a CPU 14, a head controller 15, a pattern detector (binarizing circuit) 16, a detector 17, etc. The detector 17 obtains data items concerning offsets of the heads, such as pattern element intervals on the basis of the values detected by the pattern detector 16. The CPU 14 interfaces with the external device 11, which sends the image data VDI, and controls the overall operation of the print controller 12, including memories (not shown) for storing data and programs, I/O (Input/Output), etc. Specifically, when the image data VDI comes from the external device 11, the head controller 15 temporarily stores a few bands of the image data VDI in an image memory in response to instructions from the CPU 14. The stored image data VDI is then subjected to various image processing so as to produce image data VDO in synchronization with the scanning of the heads 13.

In this event, the synchronization of the print control such as the output of the image data VDO, etc. is realized with a signal LINSCL which is generated, in synchronization with the scanning of the heads 13, from a linear encoder 18 (constituted by a linear scale 7 in FIG. 2 and a scale sensor).

The head controller 15 also serves to generate enable signals BENBO-7 for blocks of each head 13, each of the heads including a plurality of blocks wherein each of the blocks includes a plurality of nozzles, and heater drive pulses HENB which are signals for ejecting ink from the nozzles. In this embodiment, one head 13 including 128 nozzles is divided into 8 blocks, and hence, there are eight enable signals for each head.

The image data VDO, block enable signals BENBO-7, heater driving pulse signals HENB, etc. are transferred to the heads 13. In the control circuit inside the head 13, only nozzles with their image data VDO, and enable signals (BENB, HENB) enabled, are turned ON to eject ink drops from the nozzles onto the recording paper sheet (5 in FIG. 2) such that a column of image dots corresponding to the nozzle array is formed. While such control is being repeated, the heads 13 are scanned in the main-scanning direction to thereby form a band of image.

In the embodiment, there are four pairs (four circuits) of the head controller 15 and the head 13, which are provided with an integrated type of ink tank of cyan, magenta, yellow and black, respectively, to realize a full-color printing. Hereinafter, only one circuit (pair) will be explained.

Figure 3:
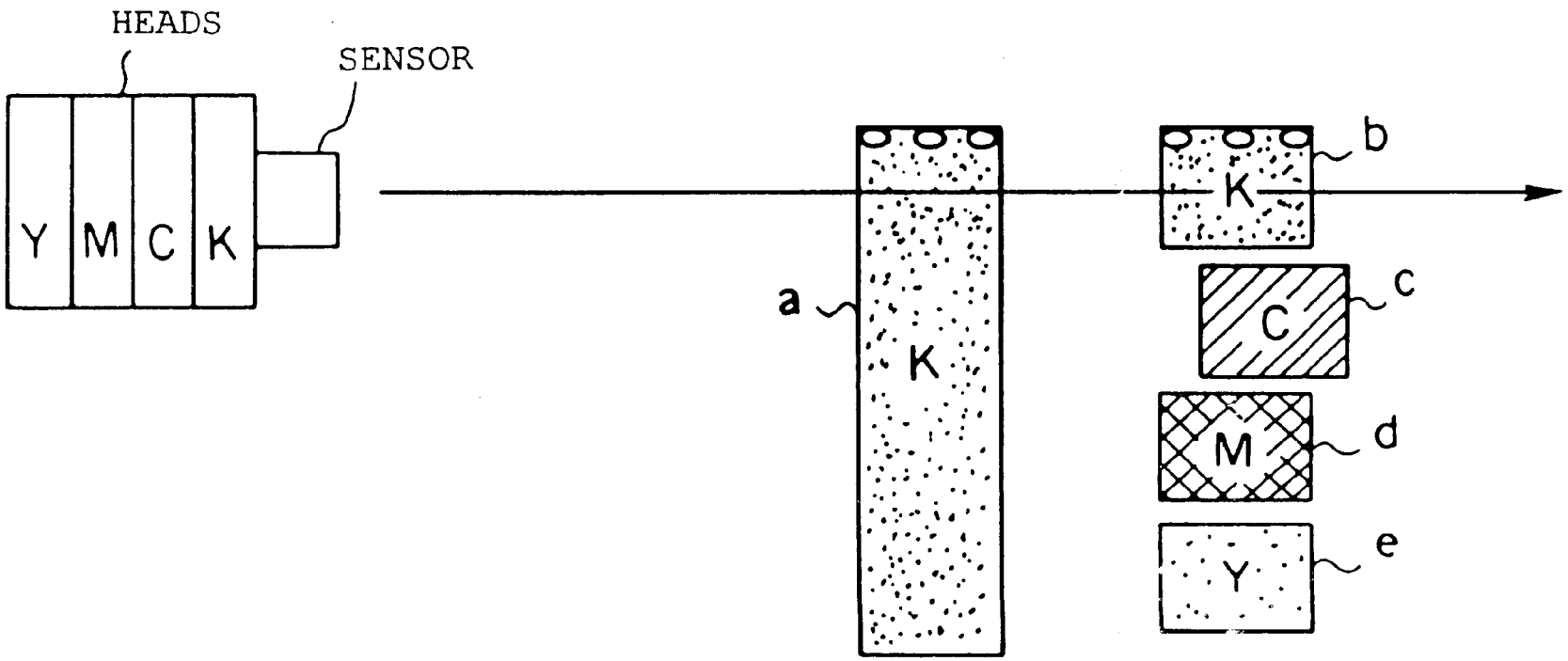
FIG. 3 shows a general configuration of a test pattern used.

In addition, a sensor is provided adjacent to the four heads such that after a test pattern as shown in FIG. 3 is printed, the sensor reads individual pattern elements to detect the pattern element intervals. This test pattern, per se, is similar to that shown in the above-mentioned prior art technique. FIG. 3 shows a test pattern for detecting a registration offset in a horizontal (main-scanning) direction. The detail of this test pattern will be described below with reference to FIG. 5.

Figure 4:
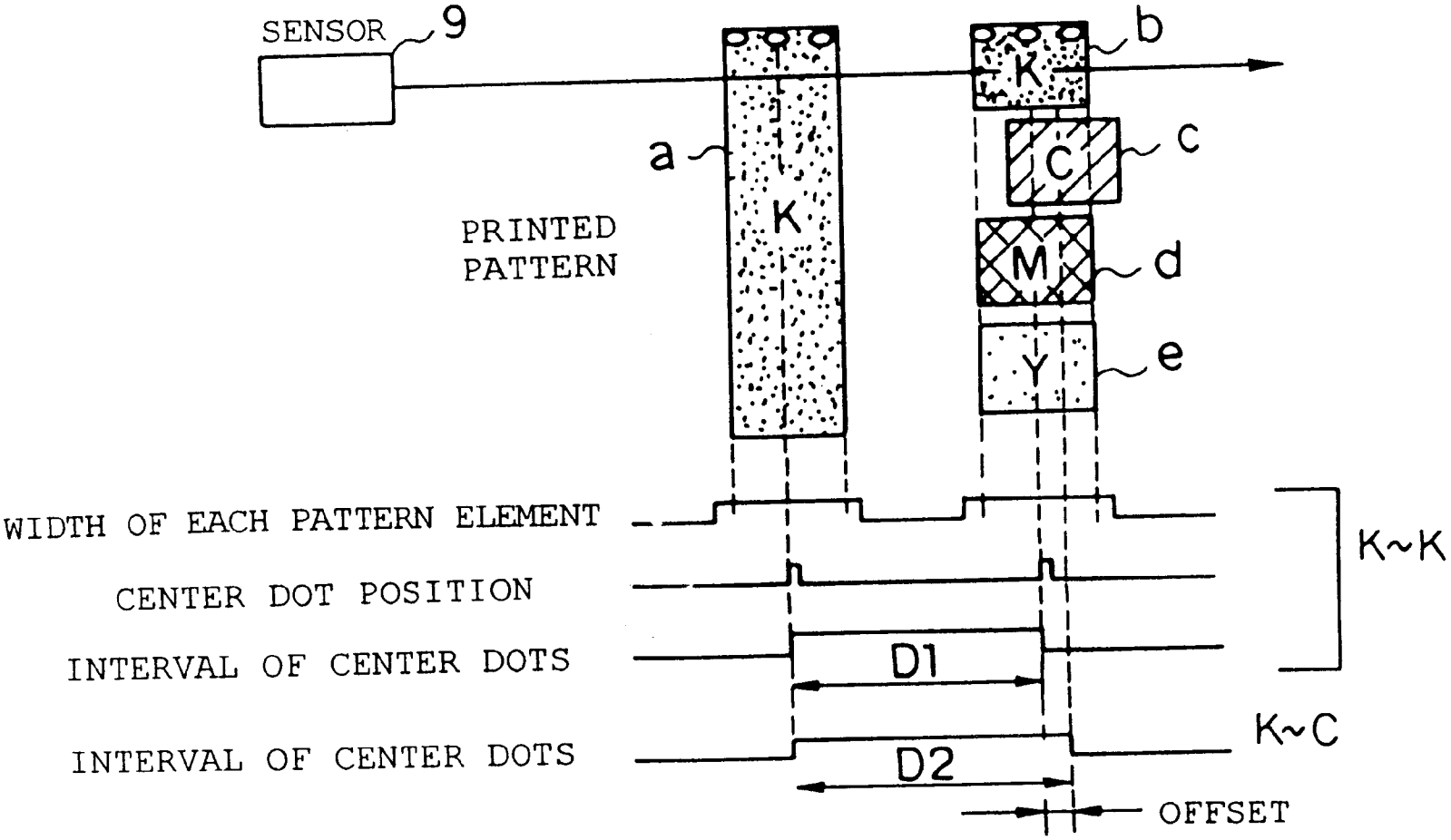
FIG. 4 is a diagram for explaining an operation for detecting a registration offset.

Referring next to FIG. 4, an explanation will be given of the detail of an operation for detecting the amount of a registration offset (i. e., the amount necessary for registration adjustment).

First, the sensor 9 is scanned over pattern elements a and b so that the pattern detector 16 in the print controller detects, based on the output of the sensor 9, the positions of the test pattern elements that change in density, and binarize the detected output into digital data with a certain threshold level. Then, an inter-pattern-element interval detector 17 obtains center dot positions of each pattern element and, at the same time, an interval D between the center dots of the pattern elements a and b. As explained below with reference to FIG. 17, the inter-pattern-element interval detector 17 may obtain only data associated with the interval D, and the CPU 14 may then calculate the interval D on the basis of the data. A specific configuration of the sensor 9 used in the embodiment will be described below with reference to FIG. 6.

Such an operation is similarly repeated with respect to pattern elements a and c; a and d; and a and e, then the respective interval data items between the center dots of the two pattern elements in question are obtained. After these interval data items are obtained, the interval data item of the pattern elements a and b is used as a reference interval data item to obtain differences between the reference interval data item and other interval data items. As a result, it is possible to calculate to what extent and in what direction each head is misaligned relative to the reference head.

In the foregoing prior art technique, the determination of one interval data item D required the head scanning (sensor scanning) twice, firstly for a process of obtaining the center dot positions and secondly for another process of obtaining the interval between the center dots. In the invention, however, the processes are performed in a single scanning.

The configuration and operation for detecting the test pattern is the most characteristic portion in the present invention, and will be explained below in more detail.

Figure 5:
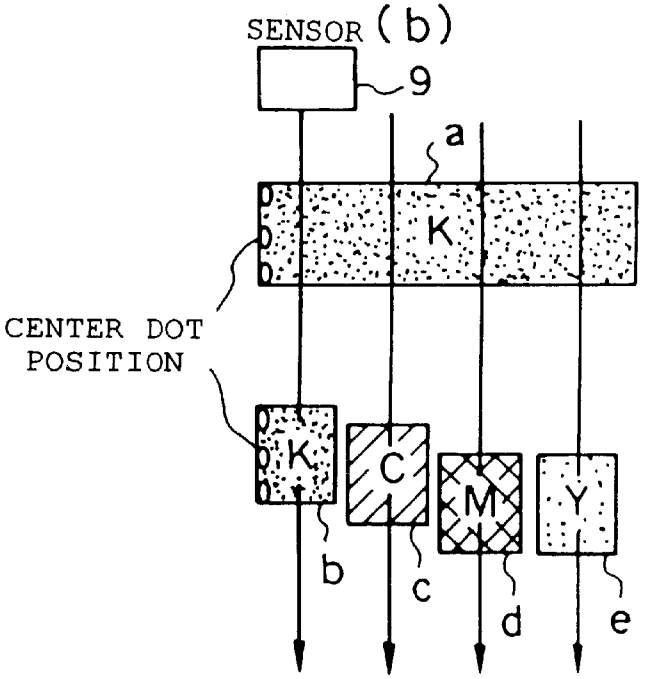
FIGS. 5(*a*) and (*b*) are diagrams of test patterns respectively for detecting horizontal registration offset and vertical registration offset.
Figure 5:
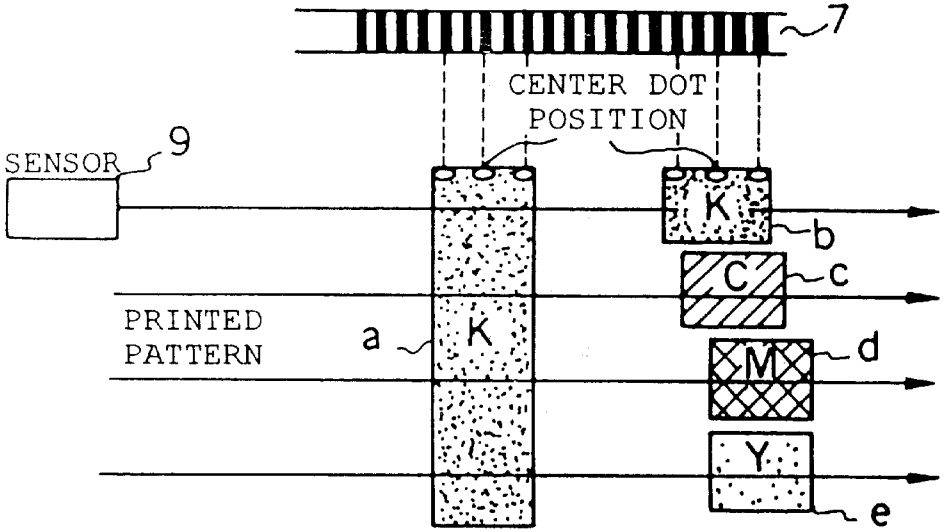

First, the test pattern is described with reference again to FIGS. 5(*a*) and (*b*). FIG. 5(*a*) shows a test pattern for detecting a horizontal registration offset and FIG. 5(*b*) shows a test pattern for detecting a vertical registration offset. In this specification, the pattern element a is used as a reference element for measuring the interval, and hence, called "reference pattern element". The other pattern elements b, c, d and e are compared with the reference element, and hence, "called comparative pattern elements".

In FIG. 5(*a*), the pattern elements a and b are printed with a reference head. The pattern elements c, d and e are used to determine the positions of the heads with other color ink tanks relative to the reference head. Here, the pattern elements a and b are printed by the head with a black (K) ink tank, and the pattern elements c, d, e are printed by the heads with cyan (C), magenta (M) and yellow (Y) ink tanks, respectively.

In FIG. 5(*a*), the comparative pattern elements c, d and e are illustrated not in a line with the comparative pattern element b. It should be noted that the printing was intended to put them in a line but the print resulted in the offsets because of the horizontal misalignment of the heads.

After printing such test patterns, with respect to the test pattern for detecting the horizontal registration offset the carriage carrying the sensor 9 is moved in the main-scanning direction to read the pattern elements. With respect to the test pattern for detecting the vertical registration offset, the sensor 9 is moved onto the pattern and then the paper sheet is transported in the sub-scanning direction for the sensor to read the pattern elements. Thus, the intervals between pattern elements are detected.

Figure 6:
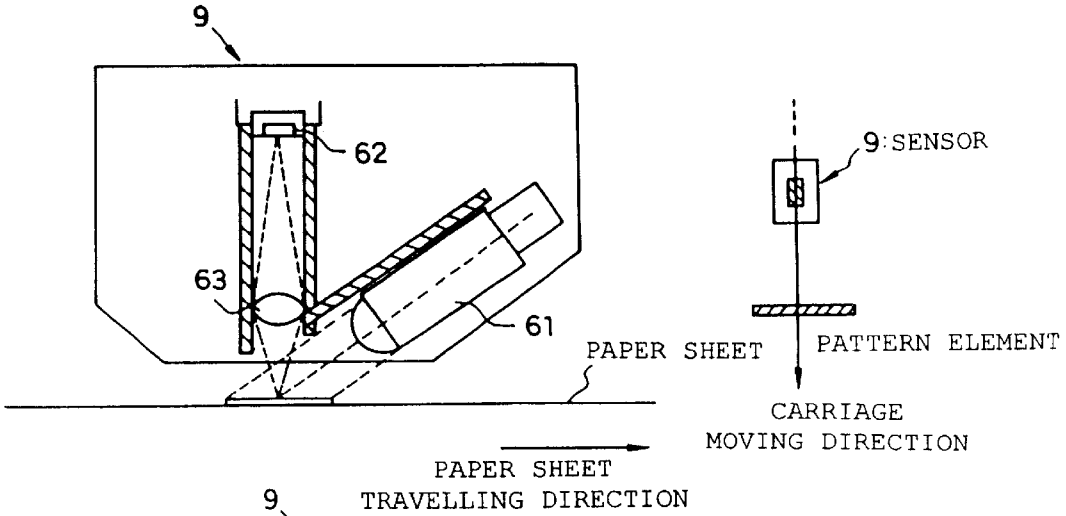
FIGS. 6(*a*) and (*b*) show first and second examples of an internal configuration of the reflection-type optical sensor which is used in the embodiment of the present invention.
Figure 6:
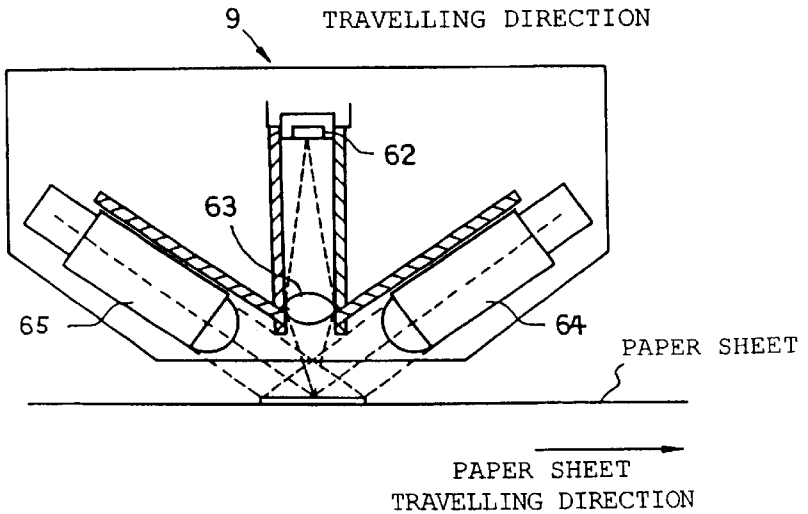
Figure 7:
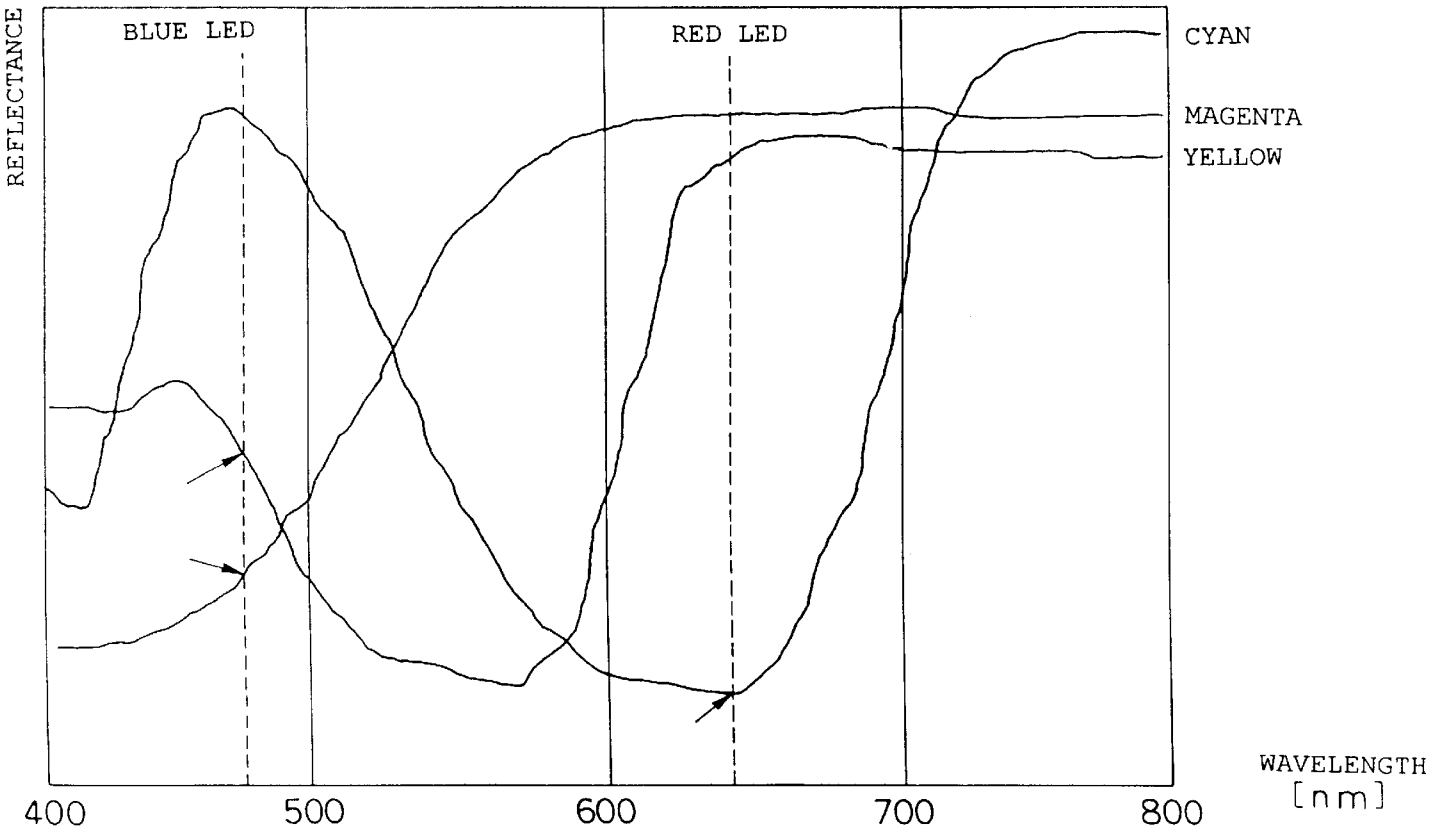
FIG. 7 shows graphs showing characteristics of reflectance v.s. wave length for each color ink.

Referring next to FIGS. 6 and 7, an explanation will be given of the configuration and operation of the sensor 9 for detecting the test patterns.

FIG. 6(*a*) shows the internal configuration of the sensor 9 which is used in the present embodiment. This sensor 9 comprises a light receiving element (photodiode) 62, a light emitting element (bi-color light emitting diode) 61, a lens 63, etc. This type of sensor is generally called "reflection type optical sensor". The reflection type optical sensor emits light from its light emitting part towards an object to be detected so that its light receiving part receives the reflected light to detect the object. In this embodiment, the object to be detected is the pattern elements printed on a recording paper sheet. In order to ease the recognition of the pattern elements, the difference between the sensor outputs when detecting the paper background and the pattern elements, has to be great.

FIG. 7 shows the characteristics of reflectance regarding the pattern elements of different colors. The reflectance represents a ratio of the energy of the reflected light relative to the irradiated light energy. Therefore, the larger is the difference in reflectance between the object to be detected and other portion, the greater becomes the difference of the sensor outputs, which facilitates the detection of the object. When only one wavelength of light is emitted from the light emitting part, the candidate of light to be used may be light of green to blue range having a wavelength of around 500 nm, assuming that the reflectance of paper is high and approximately 100%. However, this range of light causes cyan to be highly reflective, which makes it difficult to distinguish the color from the paper background when actually attempting to detect the test pattern. Then, as mentioned above, the light emitting part of the sensor according to the embodiment employs the bi-color LED in which two colors of red R (640 nm) and blue B (470 nm) are available. The red light is used for the black and cyan pattern elements and the blue light is used for the magenta and yellow pattern elements, so as to expand the difference in reflected light intensity between the paper background and the respective pattern elements to be detected. Alternatively, the bi-color emitting LED may be a combination of a blue LED 64 and a red LED 65 as shown in FIG. 6(*b*).

Other parts will be described. The lens 63 is 5 mm in diameter and has, on its surface, a round aperture of 2 mm in diameter. This lens 63 is disposed in position that causes an image printed on the paper sheet to be focussed on the light receiving element with the image size magnified twice. The light receiving element 62 is a photodiode having a receiving plane of 2 mm×3 mm. The photodiode is an optical semi-conductor device which transforms light into an electric current. The light energy irradiated from the light emitting element 61 hits the test pattern on the paper sheet, and the reflected energy reaches through the lens 63 to the light receiving element 62. The test pattern is detectable by monitoring the output current from the light receiving element 62. Since the sensor is a two-fold magnification reading system with the aperture of 2 mm in diameter, the detectable range on the paper sheet is a circle of 1 mm in diameter.

Figure 8:
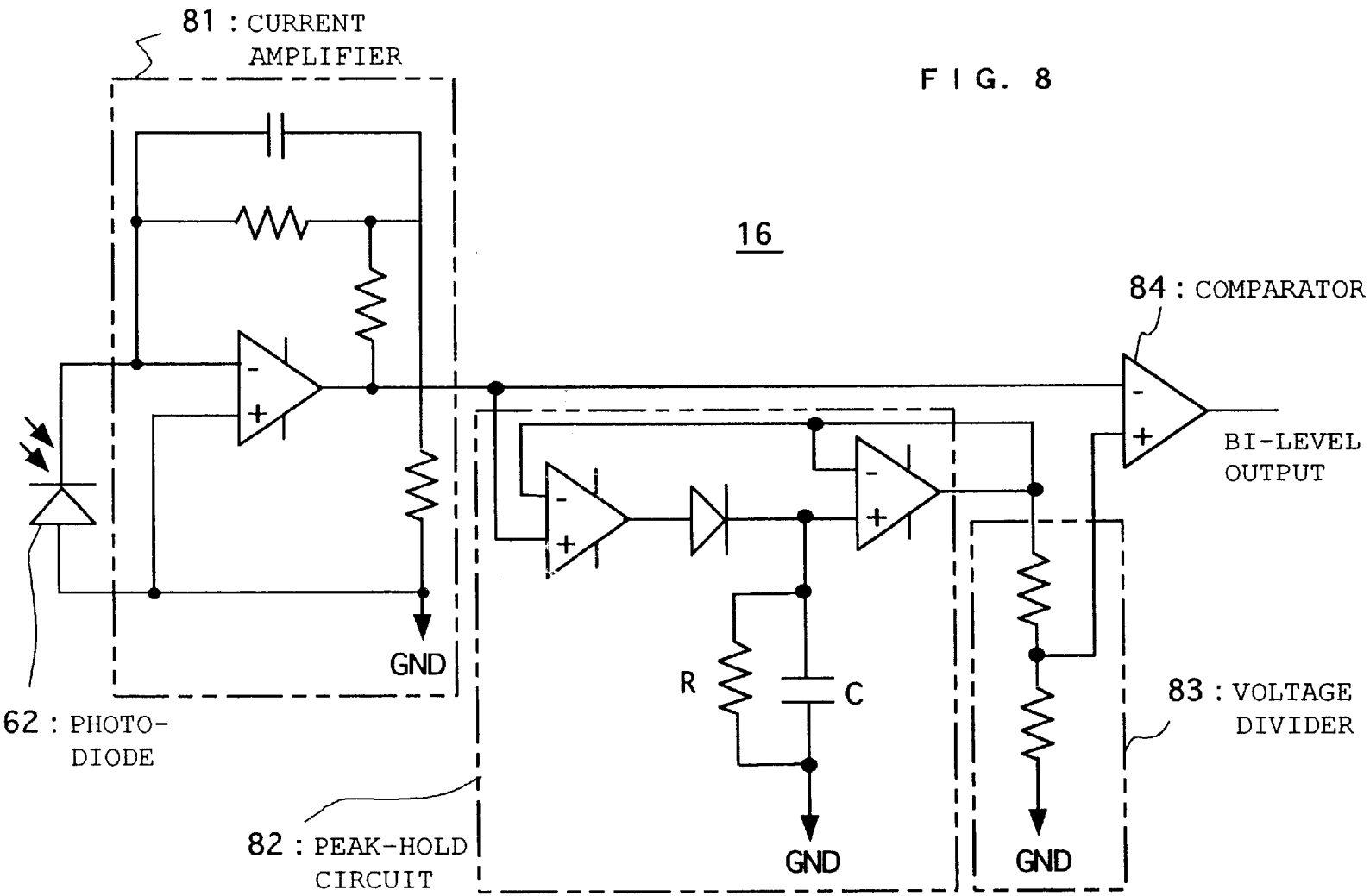
FIG. 8 is a circuit diagram which shows an exemplary circuit of pattern detector 16 shown in FIG. 1.

Referring to FIG. 8, there is illustrated an exemplary circuit of the pattern detector 16 shown in FIG. 1.

In FIG. 8, numeral 81 indicates a current amplifier for converting the output current of the photodiode 62 (FIG. 6) into a voltage; numeral 82 indicates a peak-hold circuit for holding the peak of the output from the current amplifier 81 (or slowly follows the peak); numeral 83 indicates a voltage divider for dividing the peak voltage detected by the peak-hold circuit 82; and numeral 84 indicates a comparator for comparing the output of the current amplifier 81 with the divided output of the peak-hold circuit 82, using the divided output as a threshold.

Figure 9:
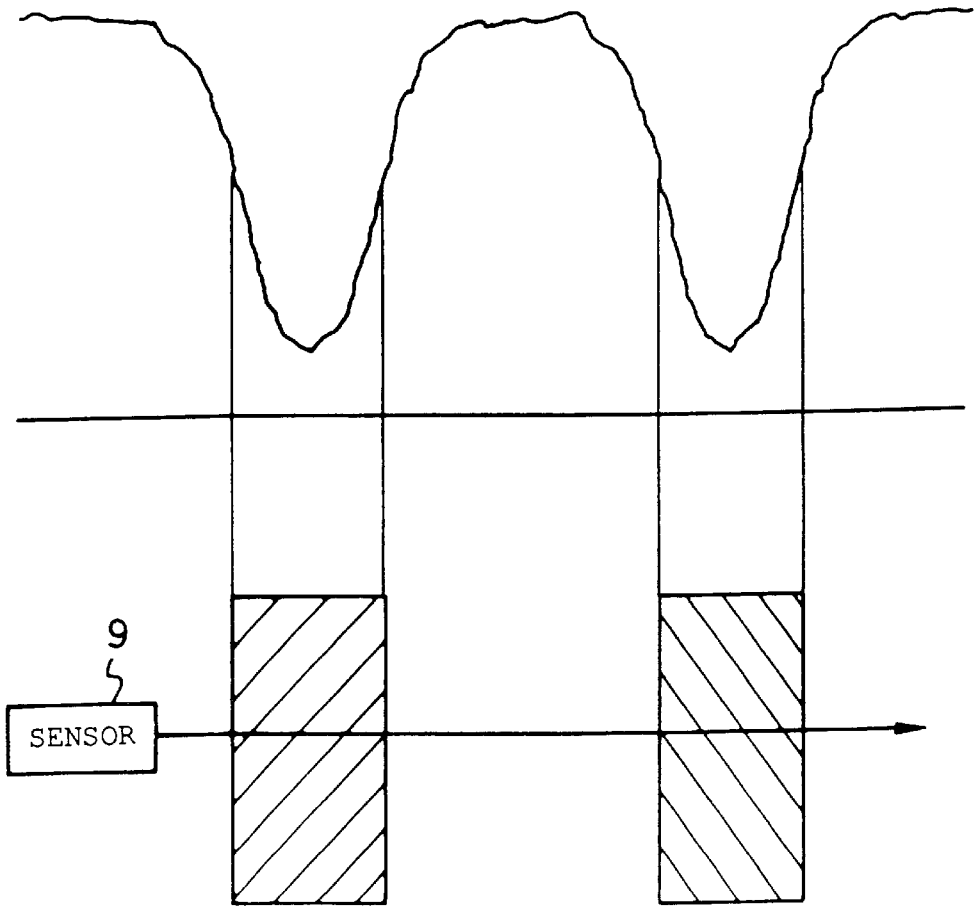
FIG. 9 shows an output signal waveform of sensor 9 when the test pattern is read by the sensor 9.

FIG. 9 shows the output signal waveform of the sensor 9 when the test pattern is read by the sensor as shown in FIG. 3 with the above-described configuration of the sensor 9 and pattern detector 16. The output current of the sensor 9 is great when the background white portion (non-printed portion) of the paper sheet is being read. The output current becomes smaller when the pattern elements are being detected. Thus, the concave portions of the waveform shown in FIG. 9 represent the pattern elements being detected.

Figure 10:
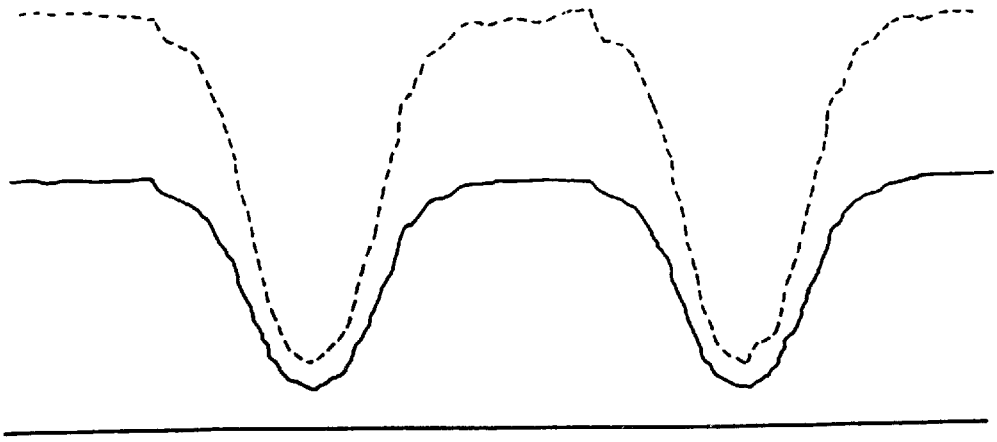
FIGS. 10(*a*) and (*b*) show waveforms (solid lines) for two cases of (a) the recording paper sheet greatly and unslantly floating above the platen, and (b) the sheet slantly floating.
Figure 10:
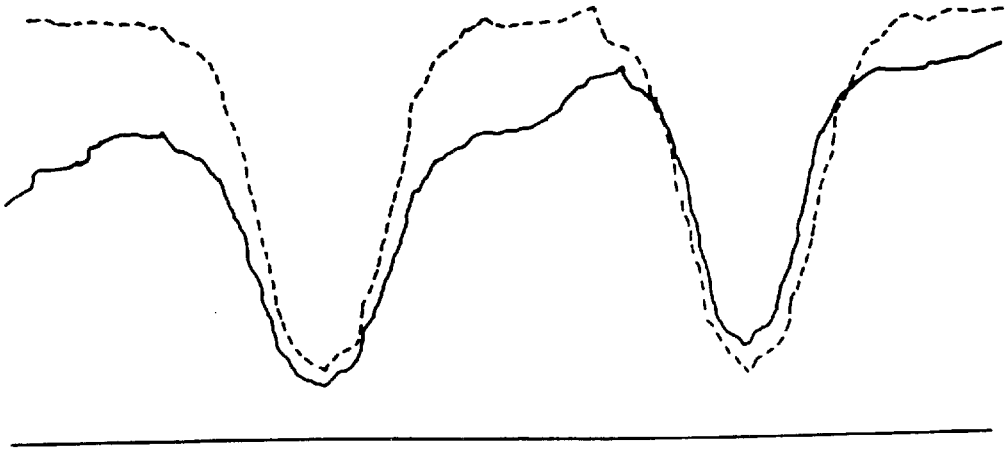

In the binarizing of such a waveform, the timings of the rising and falling edges of the binarized, bi-level output vary depending upon the level of the threshold used for the binarization. Therefore, it is a big matter for the binarizing circuit at what level the threshold is to be set. When the test pattern printed on the paper sheet is read, the offset and amplitude components of the detected waveform could vary due to the floating of the sheet, the light intensity of the light emitting element and inconstant characteristics of the parts which constitute the detector circuit. FIGS. 10(*a*) and (*b*) show waveforms (solid lines) for two cases of (a) the recording paper sheet greatly and unslantly floating above the platen, and (b) the sheet slantly floating. The dashed lines in the drawing indicate ideal waveforms.

Figure 11:
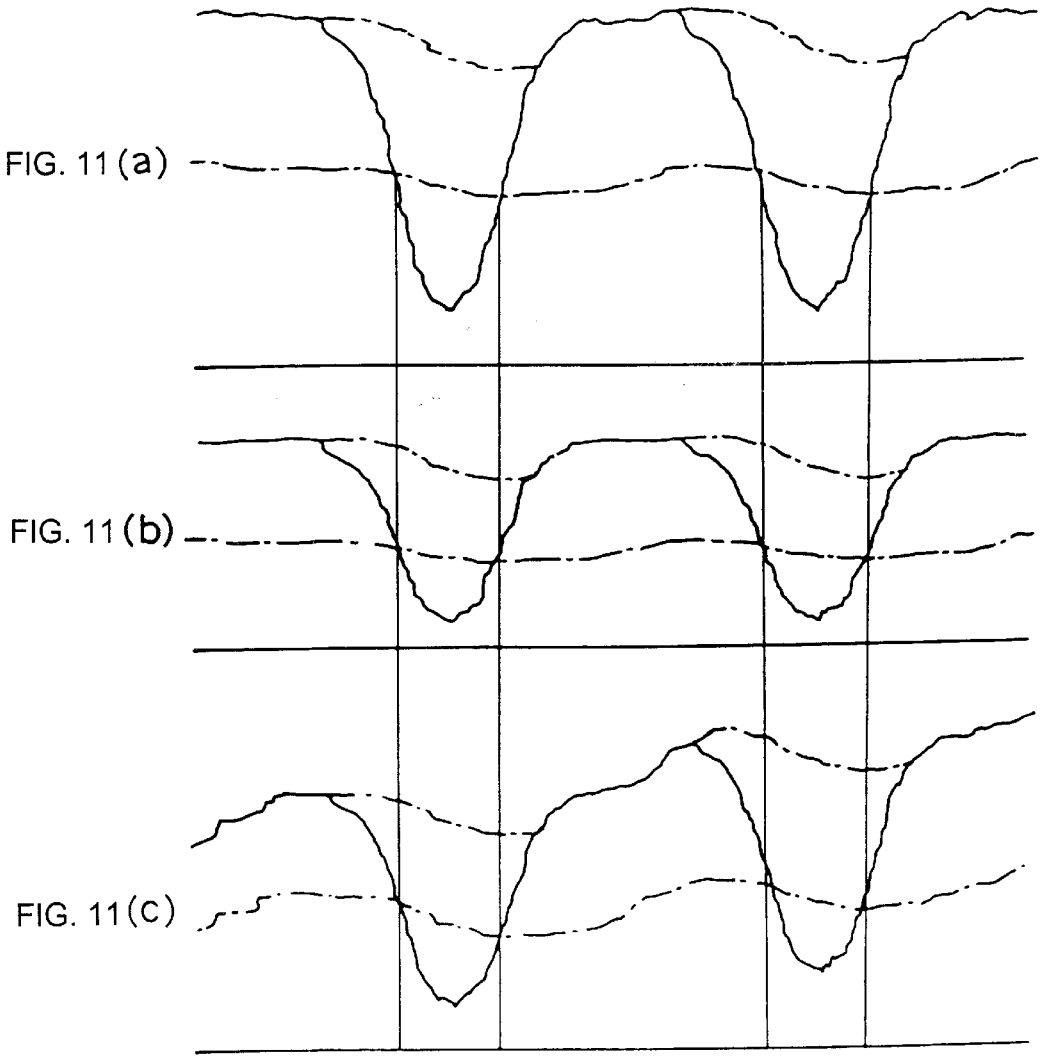
FIGS. 11(*a*)–(*c*) are signal waveforms which represent the relationship between varying output waveforms detected from a test pattern and their thresholds.

With such output waveforms of the sensor 9, the peak-hold circuit 82 (FIG. 8) cannot follow abrupt changes of the waveform, and hence, it serves to hold, at a certain time constant, the waveform level immediately before the pattern element. This held level divided by two is used as the threshold, so that the pattern element can be detected substantially at a fixed position in the main-scanning direction even though the waveform varies, as shown in FIGS. 11(*a*)–(*c*).

Figure 12:
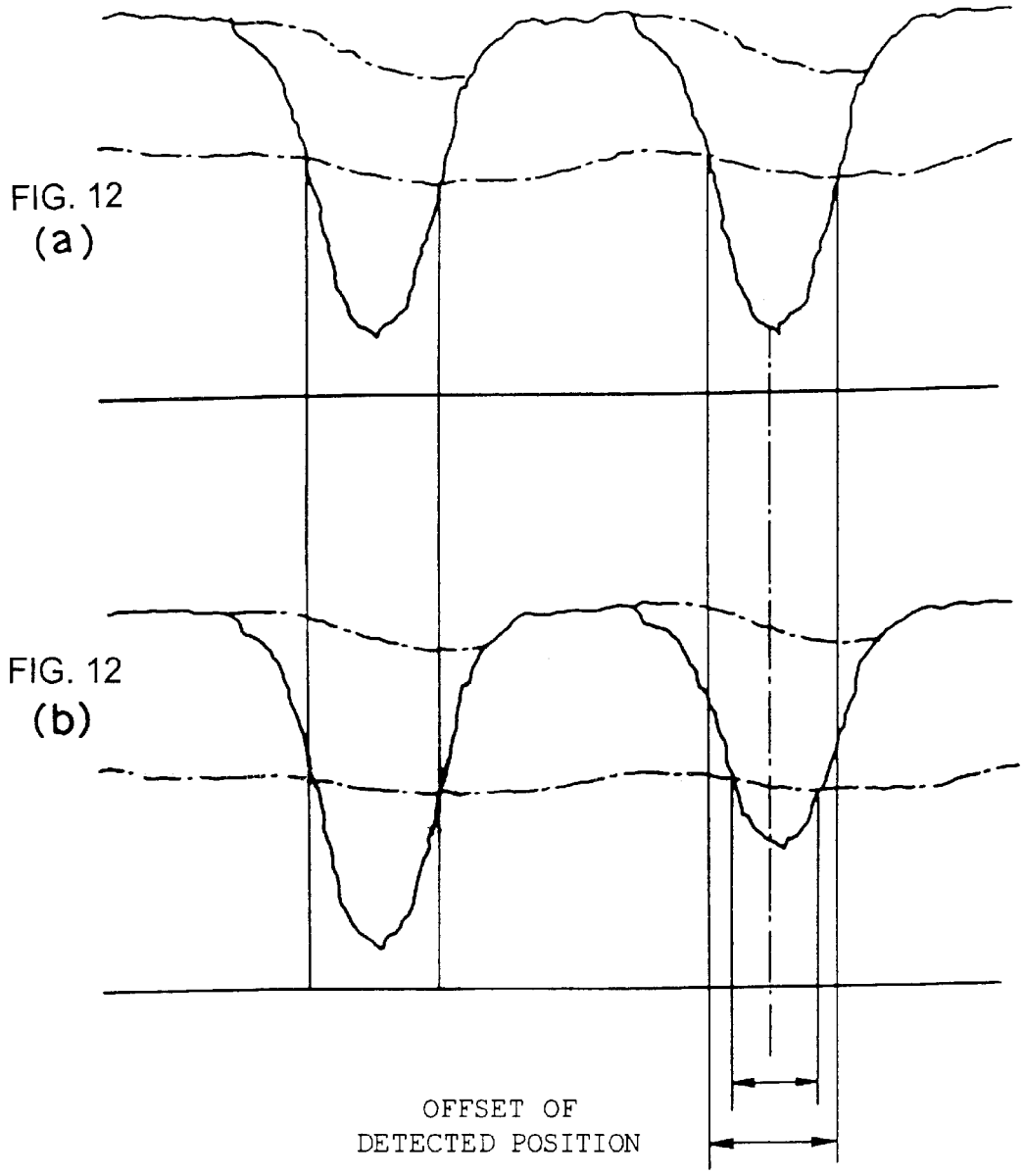
FIGS. 12(*a*) and (*b*) are signal waveforms which show variation of detected output waveforms of a test pattern when the print density varies depending upon variation of ink or its ejected amount.

Incidentally, ink used in an ink-jet printer could change in density depending upon its inconstant characteristics and the amount ejected on a paper sheet. FIGS. 12(*a*) and (*b*) show the waveforms of the sensor output. In the case of FIG. 12(*a*), the depths of the two concave portions of the waveform (magnitudes of the negative peaks) are the same with each other, but in the case of FIG. 12(*b*) they are different due to the difference of the ink density. When detecting this type of waveform, the above-described detector circuit could not compensate for the variation.

It is seen from the waveforms shown in FIGS. 12(*a*) and (*b*), however, that the midpoint between the rising and falling edges of the bi-level waveform, i. e., the timing of detecting the center position of a pattern element does not change even though the rising and falling edges change in timing depending upon the depth of the concave. Thus, the center position of the concave of the detected bi-level waveform is obtained and used as the detected position of a given pattern element.

The detection of the center position of the pattern element and the calculation of the interval between two center positions of two pattern elements are performed in an inter-pattern-element interval detector 17 which is described: below. (However, the interval calculation may be performed by the CPU 14 on the basis of data concerning the interval.)

Figure 13:
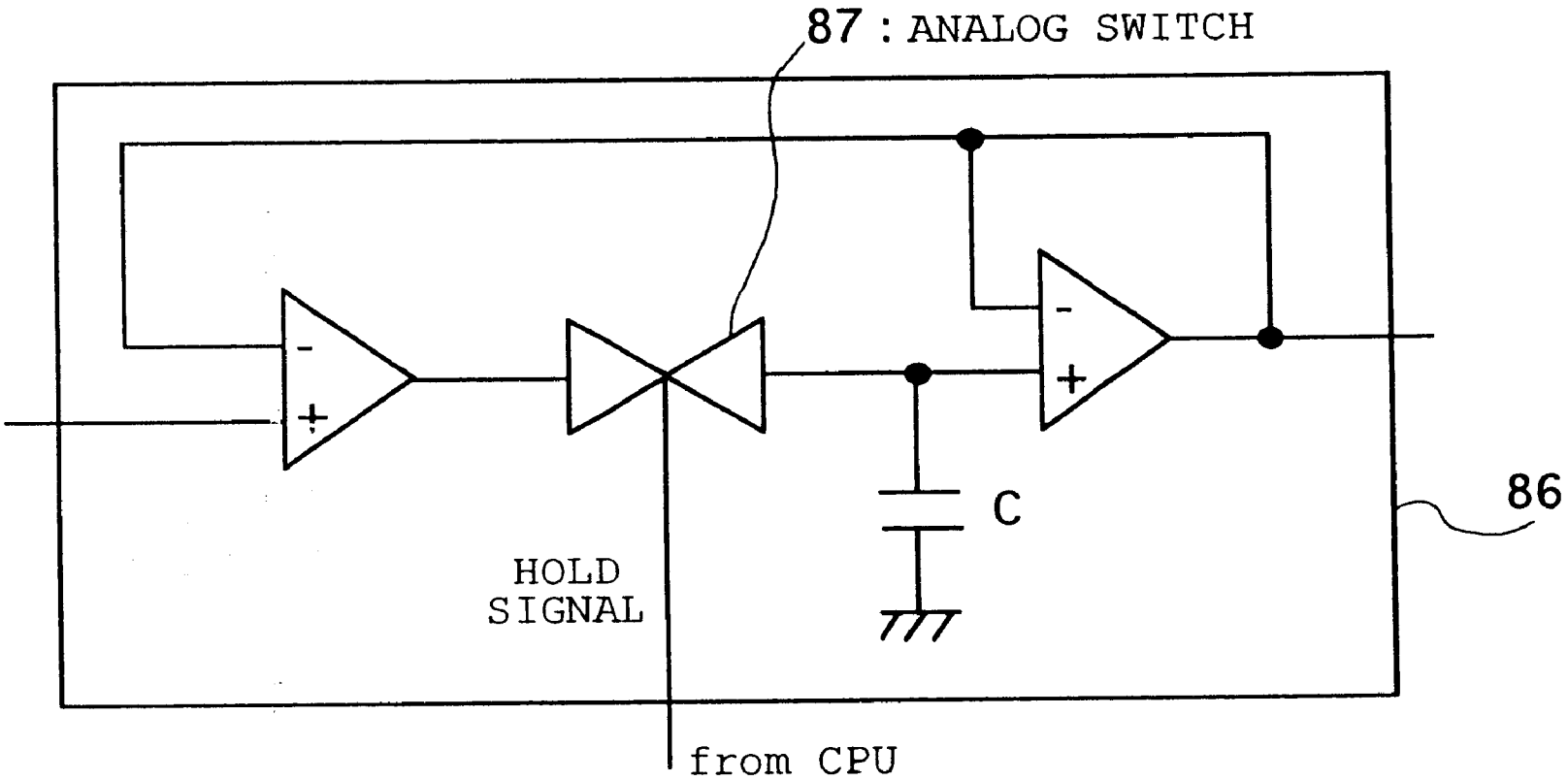
FIG. 13 is a circuit diagram which shows sample-hold circuit 86 in place of the peak-hold circuit 82 shown in FIG. 8.
Figure 14:
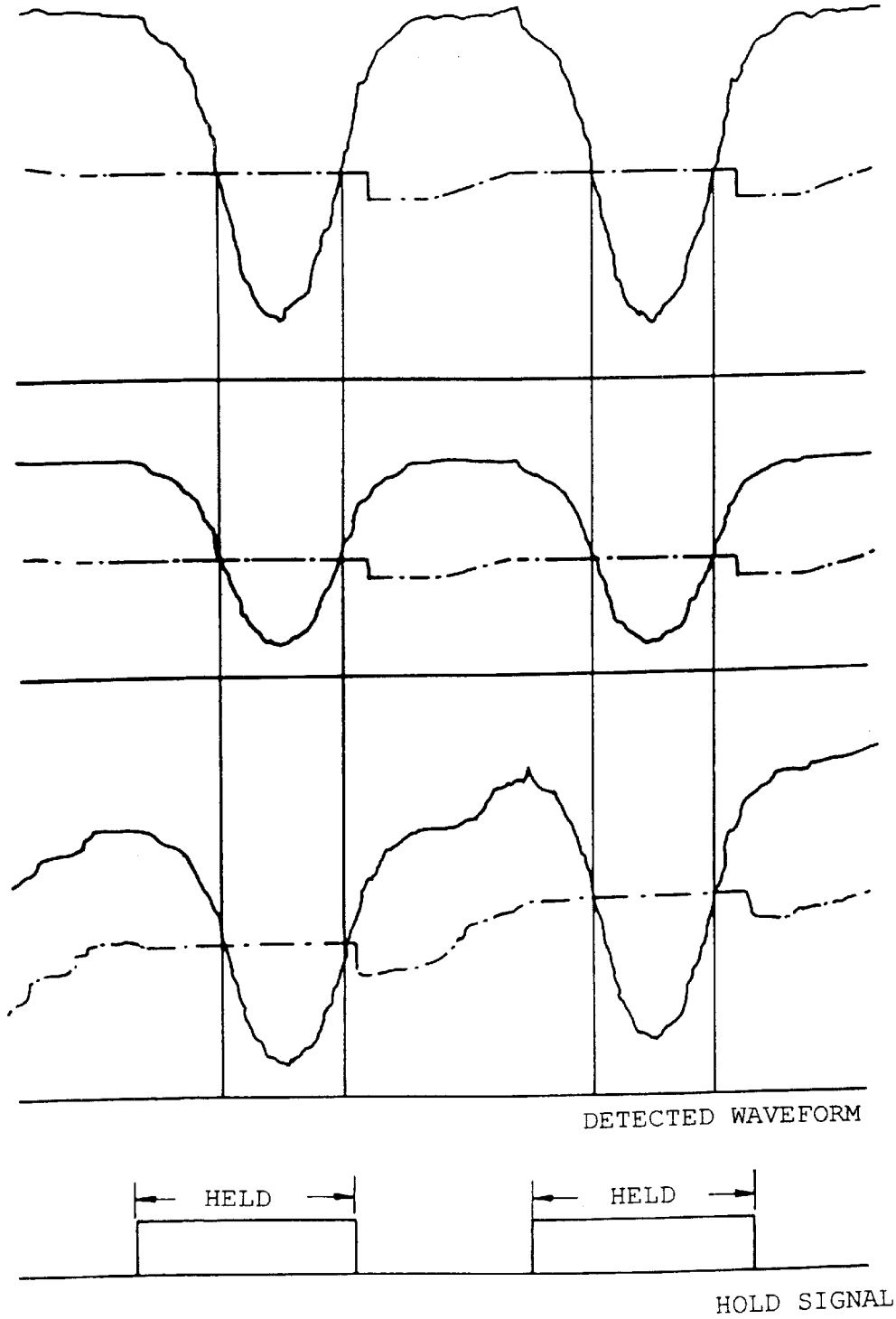
FIG. 14 shows signal waveforms for explaining the operation of the sample-hold circuit 86 shown in FIG. 13.

Referring to FIG. 13, there is shown a sample-hold circuit 86 which is usable in place of the peak-hold circuit 82. This, is to control an analog switch 87 in response to a hold signal from the CPU 14 so that the sensor output is sampled and held at a predetermined timing immediately before the beginning of concave portion of the output waveform and the held level is maintained immediately after the end of the concave portion, as shown in FIG. 14. Also in this case, a threshold (dashed) line can be set at a level corresponding to the sensor output level immediately before the beginning of the concave portion, thereby making it possible to appropriately deal with the sensor output deviation due to the paper sheet floating or the like.

The inter-pattern-element interval detector 17 is constituted in the form of hardware (gate array). This allows a high-speed processing.

Figure 15:
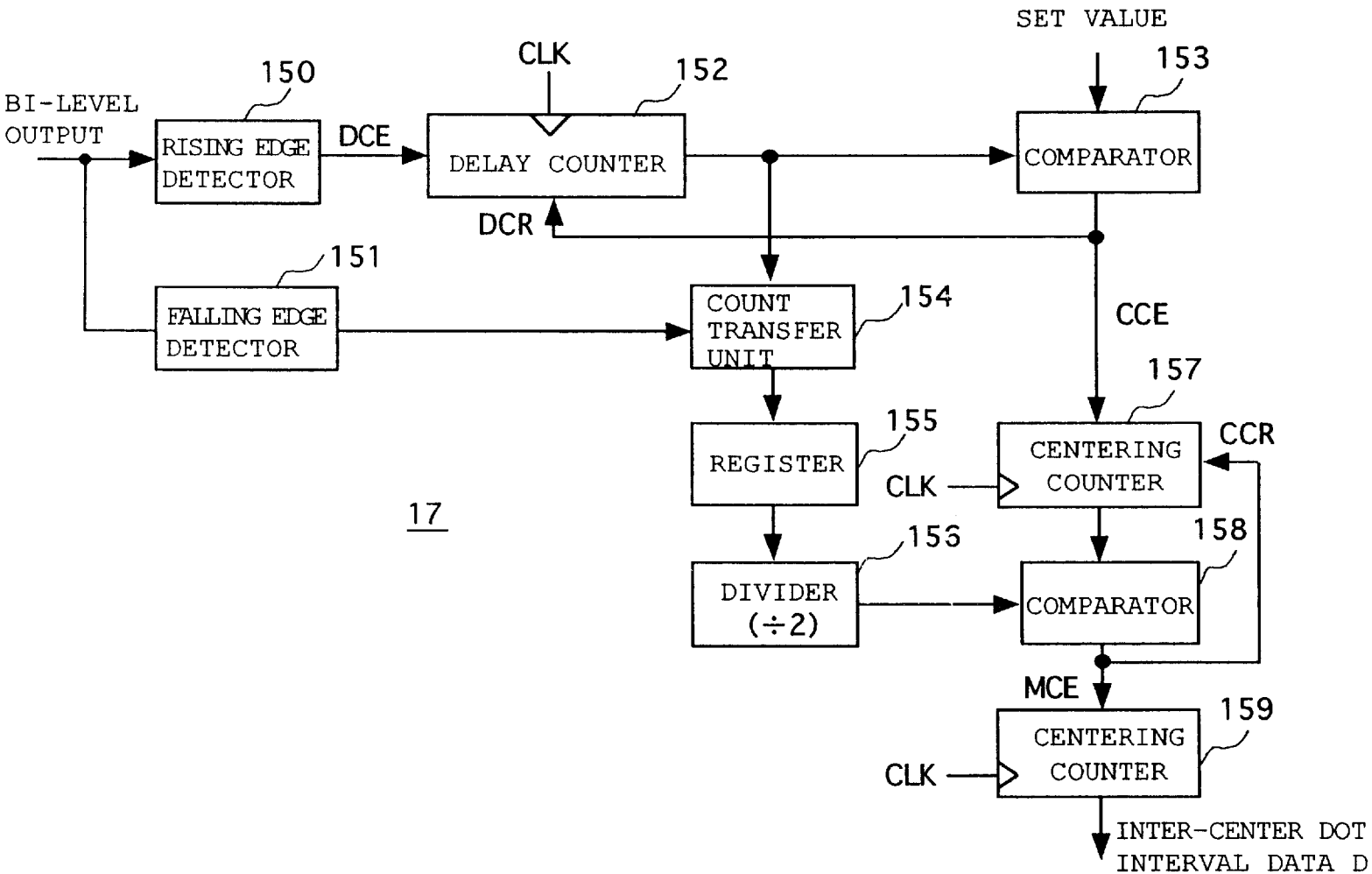
FIG. 15 is a block diagram which shows an exemplary configuration of the inter-pattern-element interval detector 17 shown in FIG. 1.

FIG. 15 shows an exemplary configuration of the inter-pattern-element interval detector 17. This detector comprises various components as illustrated in the drawing. More specifically, a rising edge detector 150 and a falling edge detector 151 receive the bi-level output from the pattern detector 16 explained above, and detect a rising edge and a falling edge, respectively, to generate detected pulses. A delay counter 152 counts a clock signal CLK during a period of time during which an output of the rising edge detector (a delay counter enable signal DCE) is at a high level. The count value is compared with a preset value in a comparator 153 which generates a delay counter reset signal DCR to reset the delay counter 152 when the two values coincide with each other. It is preferable to define the preset value so that the delay counter reset signal DCR is issued within a period between two adjacent pluses of the bi-level output corresponding to two pattern elements.

On the other hand, a count transfer unit 154 is activated at the time when a falling edge is detected by the falling edge detector 151, at the time of which the count value of the delay counter 152 is loaded in a register 155. The count value loaded in the register 155 represents the width of a first pattern element. This value is halved in a divider 156 and applied to a comparator 158 stated below.

Figure 16:
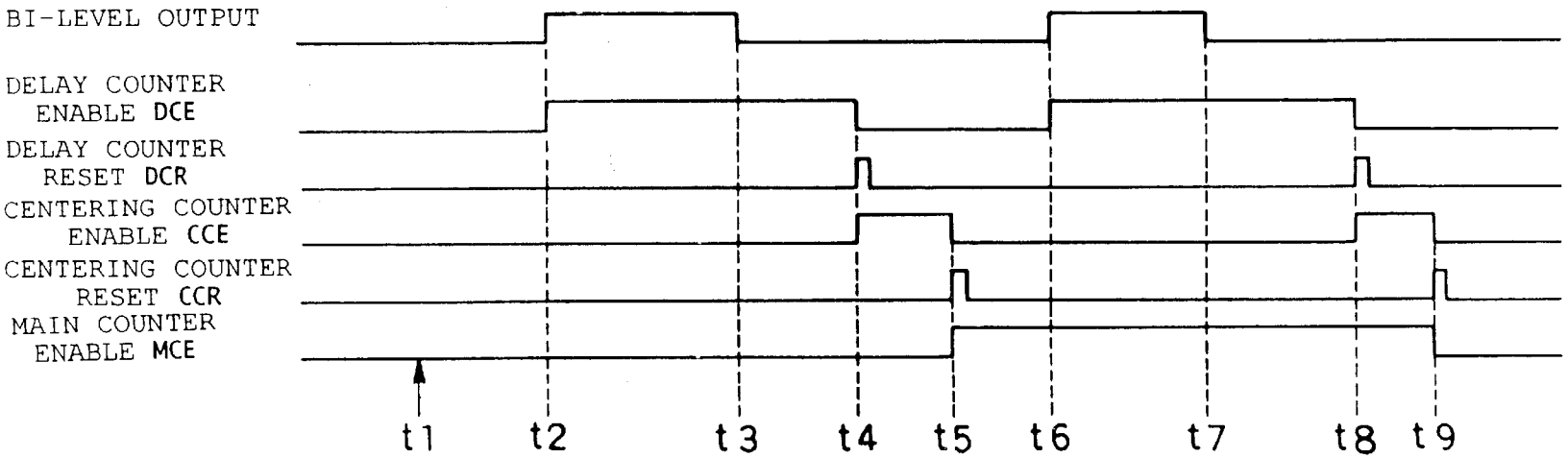
FIG. 16 is a timing chart which shows waveforms of principal signals of various parts in the circuit shown in FIG. 15.

The output from the comparator 153 is also used as an enable signal CCE for a centering counter 157. The centering counter 157, while being enabled, counts the clock CLK and the count value is compared with the value from the divider 156. When the both values coincide, the reset signal CCR resets the centering counter 157. At the same time, a main counter 159 is enabled. The main counter 159, while being enabled, counts the clock CLK. The counting of the main counter 159 is stopped when the reset signal CCR is issued again from the comparator 158. The count value of the main counter 159 at this time represents an interval data D between the center dots. FIG. 16 shows waveforms of principal signals of various parts in the circuit shown in FIG. 15. With reference to this timing chart, an operation of the circuit will be explained below.

At a time t1, before detecting a test pattern, an initializing process is performed to reset all the counters 152, 157 and 159.

At a time t2, the rising edge of the reference pattern element is detected, at the time of which the delay counter 152 is started.

At a time t3, the falling edge of the reference pattern element is detected. At this time, the count value of the delay counter 152 is transferred to the register 155 and divided by two in the divider 156 and the resultant value is stored. This resultant value represents a half of the width of the reference pattern element.

At a time t4, when the count value of the delay counter 152 reaches a preset value, the delay counter 152 is reset and the centering counter 157 is started.

At a time t5, the count value of the centering counter 157 reaches the half value of the reference-pattern-element width from the divider 156. At this time, the centering counter 157 is reset and the main counter 159 is started.

At a time t6, a rising edge of the bi-level output is detected corresponding to a comparative pattern element, at the time of which the delay counter 152 is restarted.

At a time t7, a falling edge of the bi-level output is detected corresponding to the comparative pattern element, at the time of which the count value of the delay counter 152 is transferred to the register 155 and divided by two in the divider 156.

At a time t8, the count of the delay counter 152 reaches a preset value. At this time, the delay counter 152 is reset and the centering counter 157 is restarted.

At a time t9, the count value of the centering counter 159 is coincident with the output of the divider 156. At this time, the centering counter 157 is reset and the counting of the main counter 159 is stopped. As mentioned above, the count value of the main counter 159 at this time represents the data D of the interval between the center positions of the reference and comparative pattern elements.

As clearly seen from the timing chart shown in FIG. 16, in the embodiment, a single scan of the sensor 9 is sufficient to obtain the interval data between two pattern elements. The difference between the reference interval data item and other interval data item can be calculated by the CPU 14.

Figure 17:
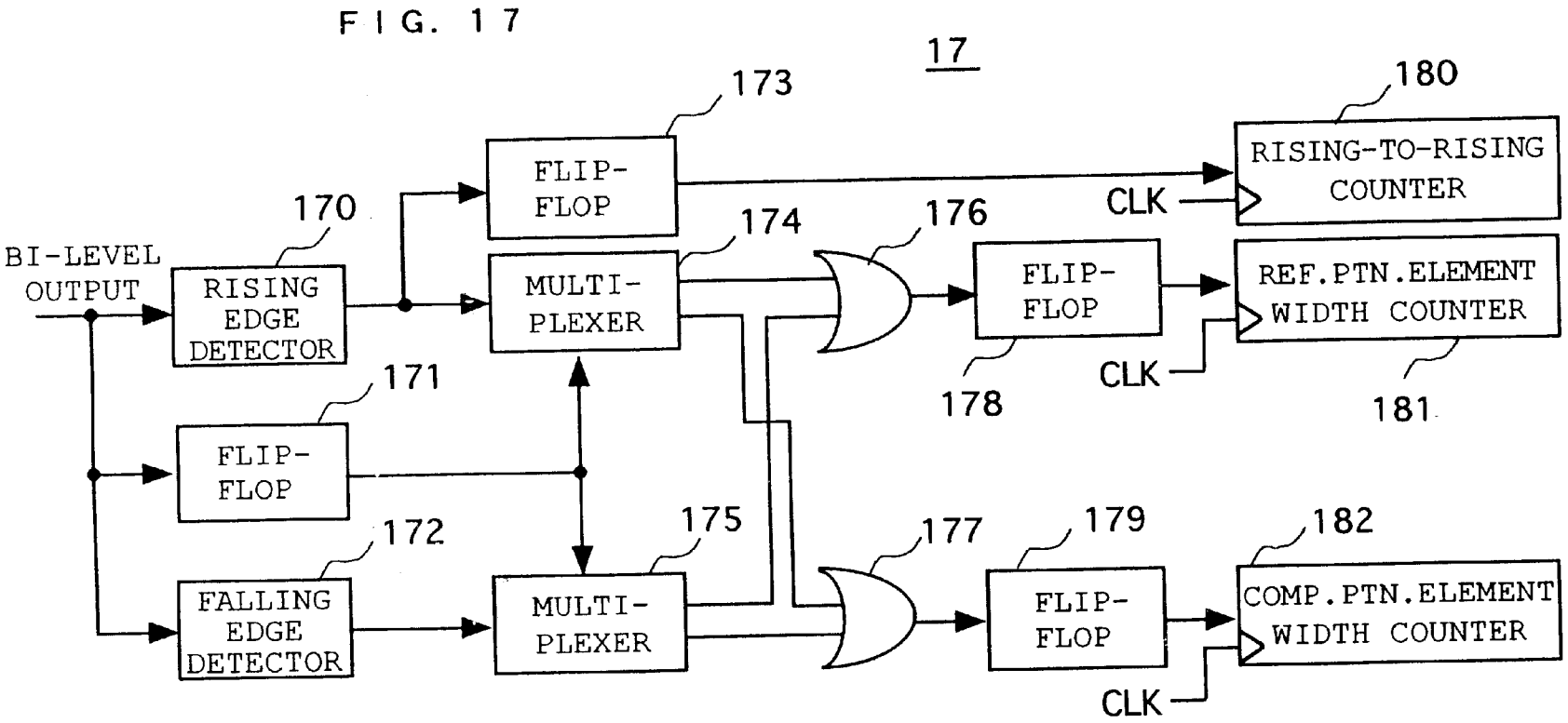
FIG. 17 is a block diagram which shows another exemplary configuration of the inter-pattern-element interval detector 17.
Figure 18:
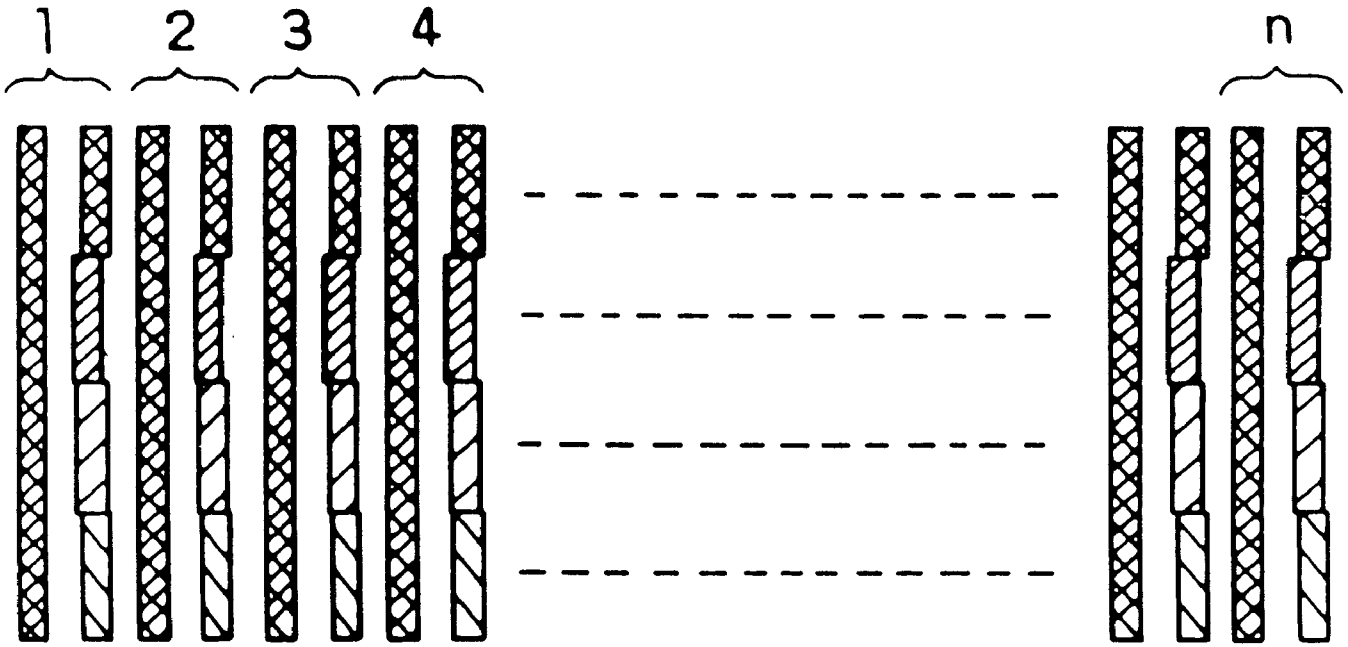
FIG. 18 shows a configuration of a test pattern including n-sets of successive patterns.

Referring next to FIG. 17, there is shown another configuration of the inter-pattern-element interval detector 17. This configuration is preferable to use when a plurality (n) of sets of test patterns are successively printed, as shown in FIG. 18, so that an average value is obtained from a plurality of similar interval data items.

Assume now that n sets of test patterns are used. Letting "xi" be the width of a reference pattern element of each set, "yi" be the width of a comparative pattern element, and "di" be the interval between the start positions (rising edges) of reference and corresponding comparative pattern elements, then an interval "D" between the center dot positions of the reference and corresponding pattern elements is represented by the following formula:

$$Di=(di+yi/2-xi/2)$$

Then, an average interval Da between center dots is represented by:

$$Da=\Sigma(di+yi/2-xi/2)/n$$

This average inter-center-dot interval Da is transformed into:

$$\begin{aligned} Da &= \left\{\sum(di)+\sum(yi/2)-\sum(xi/2)\right\}/n \\ &= \left\{\sum(di)+\left(\sum(yi)\right)/2-\left(\sum(xi)\right)/2\right\}/n \end{aligned}$$

This leads that the total sums of all the sets Σ(di), Σ(yi) and Σ(xi) are first calculated and then on the basis of the results the value Da can be calculated.

The circuit shown in FIG. 17 is based on this concept.

In FIG. 17, a rising edge detector 170 generates a pulse of one-clock width when detecting a rising edge in the bi-level output. Similarly, a falling edge detector 172 generates a pulse of one-clock width when detecting a falling edge in the bi-level output. A flip-flop (FF) 171 inverts its output each time at every rising edge of the bi-level output.

A flip-flop 173 inverts its output each time an output pulse from the rising edge detector 170 is received. A multiplexer 174 routes its input signal to its upper output terminal (the side of the flip-flop 178) when the output from the flip-flop 171 is at a high level (1), and to its lower output terminal (the side of flip-flop 179), at a low level (0). Likewise, a multiplexer 175 routes its input signal to its upper output terminal (the side of the flip-flop 178) when the output from the flip-flop 172 is at a high level (1), and to its lower output terminal (the side of flip-flop 179), at a low level (0).

A rising-to-rising counter 180 counts its input clock CLK during a period of time during which the output of the flip-flop 173 is at the high level.

A flip-flop 178 inverts its output each time an output pulse from an OR gate 176 is received. Similarly, a flip-flop 179 inverts its output each time an output pulse from an OR gate 177 is received. A reference-pattern-element width counter 181 counts its input clock CLK only during a period during which the output of the flip-flop 178 is at the high level. Also, a comparative-pattern-element width counter 182 counts its input clock CLK only during a period during which the output of the flip-flop 179 is at the high level.

Figure 19:
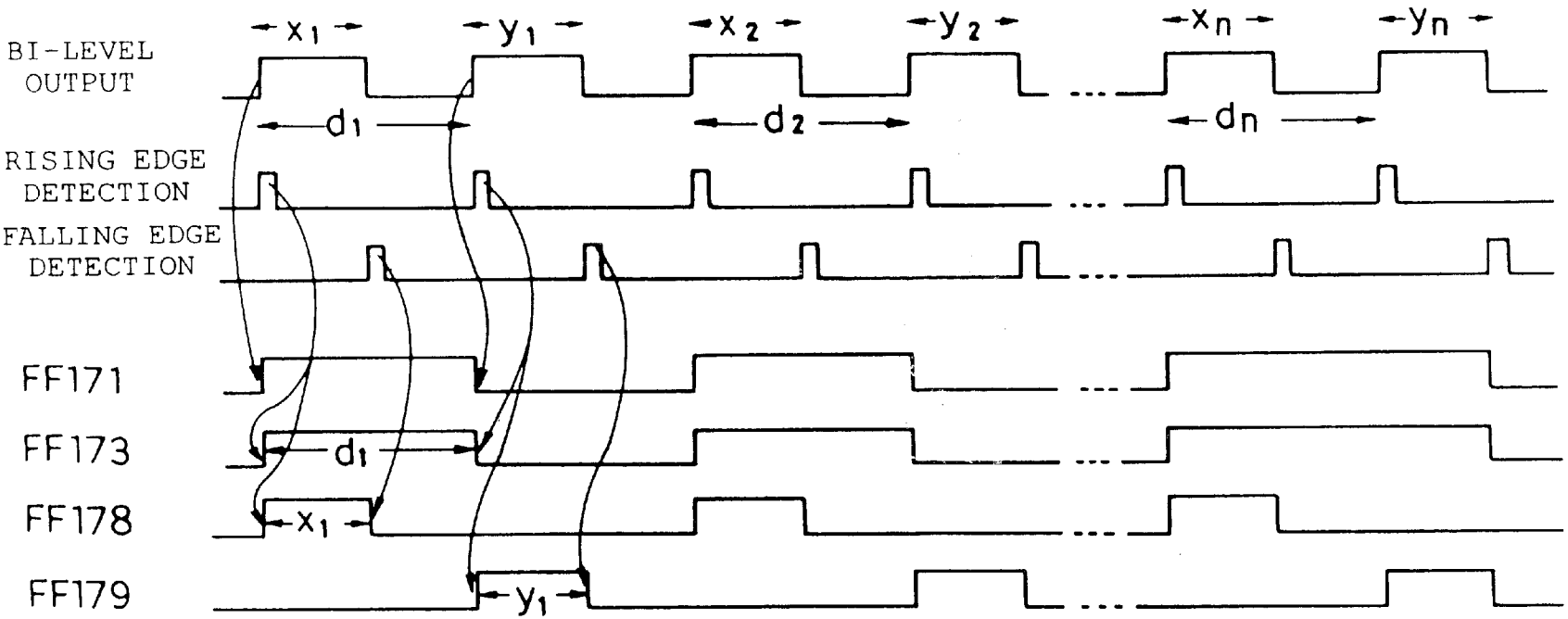
FIG. 19 is a timing chart which shows waveforms of principal signals in the circuit shown in FIG. 17.

FIG. 19 shows waveforms of principal signals of the circuit shown in FIG. 17. As seen from this drawing, the flip-flop 173 generates a signal that goes to the high level during a period from the rising edge of a reference pattern element of each set to the rising edge of a comparative pattern element of that set. After being reset immediately before one scan of the sensor 9 starts, the counter 180 is not reset during the scanning period, during which the count value is accumulated in the counter 180. In this way, the counter 180 provides finally the above-mentioned value Σ(di).

The flip-flop 178 generates a high-level signal during a period during which the reference pattern element in each set is being detected. The counter 181 also accumulates its count because it is not reset during the scanning period after being reset immediately before the one scanning of the sensor 9. Therefore, the counter 181 provides finally the above-mentioned total sum Σ(xi) of the reference-pattern-element widths.

In the same way, the flip-flop 179 generates a high-level signal during a period during which the comparative pattern element in each set is being detected. The counter 182 also accumulates its count because it is not reset during the scanning period after being reset immediately before the one scanning of the sensor 9. Therefore, the counter 182 provides finally the above-mentioned total sum Σ(yi) of the comparative-pattern-element widths.

The flip-flop 171 acts to alternately rout pairs of a rising-edge detected pulse and a falling-edge detected pulse in a pair-by-pair manner to the reference-pattern-element width counter 181 and the comparative-pattern-element width counter 182. The difference between the reference interval data and other interval data can, as in the above-mentioned case, be calculated by the CPU 14.

After the final values are obtained at the counters 180, 181 and 182 in the inter-pattern-element interval detector 17, the CPU 14 can put these values into the foregoing formula to calculate the average inter-center-dot interval data Da. In this way, the circuit configuration of FIG. 17 can also provide an interval data item for one scanning of the sensor 9.

Although preferred embodiments of the present invention have been described, various changes and modifications can be made without departing from the scope and spirit of the present invention. For example, the polarity of signals in each circuit configuration is not limited to that illustrated in the drawings.

In addition, the inter-pattern-element interval detector 17 as shown in FIG. 15 can be applied to the plural sets of test patterns as shown in FIG. 18. Conversely, the inter-pattern-element interval detector 17 as shown in FIG. 17 can be applied to the single-set test pattern.

Industrial Applicability

The present invention is applicable to the design and manufacture of ink-jet image forming devices in which it is possible to, accurately and without fault, recognize positions of the pattern elements of a test pattern printed on a recording paper sheet so as to precisely correct the relative offsets among print positions of a plurality of heads, with a relatively simple circuit configuration using a reflection type optical sensor which including a light emitting element and a light receiving element. This assures that the print positions of each head are precisely met to provide a high print quality. Also, with one scanning to read the pattern, it is possible to measure an interval of center dots of two pattern elements to be measured, thereby reducing the time necessary for the registration adjustment.

What is claimed is:

1. In an ink-jet image forming device in which a plurality of heads are scanned in a direction substantially perpendicular to a recording-medium traveling direction, said ink-jet image forming device, comprising:

a test pattern printing means for printing a test pattern on a recording medium by using said plurality of heads;

a light-reflection type optical sensor which is scanned across the test pattern printed on said recording medium for sequentially detecting pattern elements thereof;

a binarizing circuit for binarizing an output of said light-reflection type optical sensor;

a calculating circuit for obtaining a plurality of data items concerning intervals between a reference head of said plurality of heads and the other heads, on the basis of the output of said binarizing circuit; and means for determining amounts of offsets in print position of said other heads relative to said reference head;

said test pattern including a reference pattern element printed with said reference head, and a plurality of comparative pattern elements respectively printed with said plurality of heads at positions a constant designated interval away from said reference pattern element; and said calculating circuit obtaining an interval data item of one of said other heads relative to said reference head, based on the output of said optical sensor in a single scan across said test pattern, wherein said calculating circuit includes:

a rising edge detector responsive to the output of binarizing circuit for generating a pulse when detecting a rising edge thereof;

a falling edge detector responsive to the output of said binarizing circuit for generating a pulse when detecting a falling edge thereof;

a first counter for starting clock counting in response to a detected output of said rising edge detector;

a register for holding a count value of said first counter in response to said pulse of said falling edge detector;

a divider for halving the value held in said register;

a first comparator for comparing the count value of said first counter with a predetermined set value so as to stop the counting operation of said first counter when both the values coincide with each other;

a second counter for starting clock counting in response to the coincident output of said first comparator;

a second comparator for comparing the count value of said second counter with the output of said divider so as to stop the counting operation of said second counter when both the values coincide; and a third counter for starting clock counting in response to the coincident output of said second comparator;

said third counter stopping the clock counting in response to another coincident output of said second comparator which occurs again after starting said clock counting, the count of said third counter being used as said interval data item between said reference pattern element and said comparative pattern element.

2. An ink-jet image forming device according to claim 1, wherein said binarizing circuit comprises a sample-hold circuit, said sample-hold circuit serving to sample and hold the output of said optical sensor during a predetermined period corresponding to said test pattern.

3. In an ink-jet image forming device in which a plurality of heads are scanned in a direction substantially perpendicular to a recording-medium traveling direction, said ink-jet image forming device, comprising:

a test pattern printing means for printing a test pattern on a recording medium by using said plurality of heads;

a light-reflection type optical sensor which is scanned across the test pattern printed on said recording medium for sequentially detecting pattern elements thereof;

a binarizing circuit for binarizing an output of said light-reflection type optical sensor;

a calculating circuit for obtaining a plurality of data items concerning intervals between a reference head of said plurality of heads and the other heads, on the basis of the output of said binarizing circuit; and means for determining amounts of offsets in print position of said other heads relative to said reference head;

said test pattern including a reference pattern element printed with said reference head, and a plurality of comparative pattern elements respectively printed with said plurality of heads at positions a constant designated interval away from said reference pattern element; and said calculating circuit obtaining an interval data item of one of said other heads relative to said reference head, based on the output of said optical sensor in a single scan across said test pattern, wherein said calculating circuit includes:

a rising edge detector responsive to the output of said binarizing circuit for generating a pulse when detecting a rising edge thereof;

a falling edge detector responsive to the output of said binarizing circuit for generating a pulse when detecting a falling edge thereof;

a first flip-flop for inverting an output value thereof each time the pulse from said rising edge detector is received;

a first counter responsive to the output of said first flip-flop for performing clock counting during a scanning period of said sensor from the leading-edge position of said reference pattern element to that of said comparative pattern element;

a second flip-flop for inverting an output thereof each time an input pulse is received;

a second counter responsive to the output of said second flip-flop for performing clock counting during a scanning period corresponding to a width of said reference pattern element;

a third flip-flop for inverting an output thereof each time an input pulse is received;

a third counter responsive to the output of said third flip-flop for performing clock counting during a scanning period corresponding to a width of said comparative pattern element; and a switching means responsive to a bi-level output of said binarizing circuit for supplying alternately to said second and third flip-flops a pair of two detected pulses of said rising, and falling edge detectors;

said determining means obtaining an interval data item between said reference pattern element and said comparative pattern element on the basis of output values of said first, second and third counters, and determining amounts of offset in print position of said other heads relative to said reference head.

4. An ink-jet image forming device according to claim 3, wherein said test pattern includes a plurality of sets of pattern elements disposed in the sensor scanning direction, each of said sets including a reference pattern element and a plurality of comparative pattern elements; and wherein said first, second and third counters of said calculation circuit accumulatively hold the respective count values during one scanning period of said sensor.

* * * * *